US010004117B2

(12) United States Patent
Wang

(10) Patent No.: US 10,004,117 B2
(45) Date of Patent: Jun. 19, 2018

(54) AMPLIFIER FOR A CONSTANT-CURRENT LED DRIVER CIRCUIT AND CONSTANT-CURRENT LED DRIVER IC DEVICE

(71) Applicant: NXP B.V., Eindhoven (NL)

(72) Inventor: Ge Wang, Chandler, AZ (US)

(73) Assignee: NXP B.V., Eindhoven (NL)

( * ) Notice: Subject to any disclaimer, the term of this patent is extended or adjusted under 35 U.S.C. 154(b) by 94 days.

(21) Appl. No.: 14/970,392

(22) Filed: Dec. 15, 2015

(65) Prior Publication Data

US 2017/0086269 A1 Mar. 23, 2017

Related U.S. Application Data

(63) Continuation-in-part of application No. 14/861,385, filed on Sep. 22, 2015.

(51) Int. Cl.
*H05B 33/08* (2006.01)

(52) U.S. Cl.
CPC ..... *H05B 33/0815* (2013.01); *H05B 33/086* (2013.01); *H05B 33/0827* (2013.01); *H05B 33/0851* (2013.01)

(58) Field of Classification Search
CPC . H05B 33/0815; H05B 33/0851; H05B 33/51
USPC ..... 315/185, 224
See application file for complete search history.

(56) References Cited

U.S. PATENT DOCUMENTS

2005/0285676 A1 12/2005 Jones
2006/0091955 A1* 5/2006 Choi ..... H03F 1/08 330/260
2007/0013438 A1* 1/2007 Chuang ..... H03F 3/45968 330/9
2007/0236285 A1* 10/2007 Felder ..... H03F 1/26 330/9
2009/0102558 A1* 4/2009 Adachi ..... H03F 1/523 330/253
2011/0140616 A1* 6/2011 Yan ..... H05B 33/0815 315/186
2011/0215727 A1* 9/2011 Liu ..... H05B 33/0818 315/210
2014/0097762 A1 4/2014 Ide et al.
(Continued)

FOREIGN PATENT DOCUMENTS

CN 202587508 U 12/2012
EP 0 658 834 A2 6/1995

OTHER PUBLICATIONS

"STP4CMP—Low voltage 4-channel constant current LED driver with charge pump"; DocID 15770, Rev. 3; 24 pgs; Apr. 2015.
(Continued)

*Primary Examiner* — Douglas W Owens
*Assistant Examiner* — Amy Yang

(57) ABSTRACT

Embodiments of an amplifier for a constant-current light-emitting diode (LED) driver circuit and a constant-current LED driver integrated circuit (IC) device having the amplifier are described. In one embodiment, an amplifier includes a folded cascode input stage including chopping switch circuits configured to perform frequency chopping to reduce an input offset of the amplifier and a rail-to-rail output stage connected to the folded cascode input stage. The rail-to-rail output stage includes slew rate enhancement circuits.

16 Claims, 5 Drawing Sheets

(56) References Cited

U.S. PATENT DOCUMENTS

| | | | | |
|---|---|---|---|---|
| 2014/0197747 | A1 | 7/2014 | Martini et al. | |
| 2016/0233833 | A1* | 8/2016 | Mora-Puchalt ..... | H03F 1/0205 |

OTHER PUBLICATIONS

"STLED25—5 Channels step-up white LED driver"; DocID 022323, Rev. 3; 30 pgs.; May 2012.

Texas Instruments; "6-Channel Current Regulator for LED Backlight Application"; SNVS498D—Apr. 2007—Revised May 2013; 27 pgs.

Kaur, Pameet et al. "Low Power Low Noise CMOS Chopper Amplifier." International Journal of Electronics and Computer Science Engineering, vol. 1, No. 2. p. 734-740; 2010.

Texas Instruments; "TPS92640/TPS92641 Synchronous Buck Controllers for PRecision Dimming LED Drivers"; Oct. 2012.

* cited by examiner

AMPLIFIER FOR A CONSTANT-CURRENT LED DRIVER CIRCUIT AND CONSTANT-CURRENT LED DRIVER IC DEVICE

REFERENCE TO RELATED APPLICATIONS

This application is a Continuation-in-part of U.S. Utility application Ser. No. 14/861,385, filed Sep. 22, 2015, entitled "Current Mirror and Constant-Current Led Driver System for Constant-Current Led Driver IC Device," which is incorporated by reference herein.

BACKGROUND

Light-emitting diode (LED) lighting systems such as backlighting generally require high LED current accuracy and fast dimming of the current. Constant-current drivers can be used in an LED lighting system such as backlighting to provide stable current for multiple LED strings. However, a conventional amplifier typically does not satisfy the current accuracy requirement and the fast dimming requirement of a constant-current LED driver.

SUMMARY

Embodiments of an amplifier for a constant-current light-emitting diode (LED) driver circuit and a constant-current LED driver integrated circuit (IC) device having the amplifier are described. In one embodiment, an amplifier includes a folded cascode input stage including chopping switch circuits configured to perform frequency chopping to reduce an input offset of the amplifier and a rail-to-rail output stage connected to the folded cascode input stage. The rail-to-rail output stage includes slew rate enhancement circuits.

In an embodiment, the chopping switch circuits include a first chopping switch circuit and a second chopping switch circuit. The first chopping switch circuit is connected to input terminals of the amplifier, and the second chopping switch circuit is connected to the rail-to-rail output stage.

In an embodiment, the folded cascode input stage further includes a differential input stage connected to a first current source and a current sink connected to second and third current sources. The differential input stage is connected to the first chopping switch circuit and to the current sink. The current sink is connected to the second chopping switch circuit and to the rail-to-rail output stage.

In an embodiment, the first chopping switch circuit includes switches connected between input terminals and output terminals of the first chopping switch circuit. The switches are controlled by either a clock signal or an inverted version of the clock signal.

In an embodiment, the switches include a first switch connected between a first input terminal of the first chopping switch circuit and a first output terminal of the first chopping switch circuit and controlled by the clock signal, a second switch connected between the first input terminal and a second output terminal of the first chopping switch circuit and controlled by the inverted version of the clock signal, a third switch is connected between a second input terminal of the first chopping switch circuit and the first output terminal and controlled by the inverted version of the clock signal, and a fourth switch connected between the second input terminal and the second output terminal and controlled by the clock signal.

In an embodiment, the differential input stage includes first and second transistor devices. Gate terminals of the first and second transistor devices are connected to the first chopping switch circuit. Drain terminals or source terminals of the first and second transistor devices are connected to the first current source.

In an embodiment, the current sink includes a first PMOS device, a second PMOS device, a third PMOS device, a fourth PMOS device, a first NMOS device, and a second NMOS device. Gate terminals of the first and second PMOS devices are connected to the second chopping switch circuit. Gate terminals of the third and fourth PMOS devices are connected to a first voltage rail. Gate terminals of the first and second NMOS devices are connected to a second voltage rail.

In an embodiment, the rail-to-rail output stage includes a first driver circuit with a first slew rate enhancement circuit and a second driver circuit with a second slew rate enhancement circuit.

In an embodiment, the first slew rate enhancement circuit includes a voltage source, an NMOS device, and a comparator connected to the voltage source and to the NMOS device.

In an embodiment, the first slew rate enhancement circuit is configured to receive input voltages that are identical to voltages applied to gate terminals of transistor devices of the differential input stage.

In an embodiment, the rail-to-rail output stage includes a first PMOS device, a second PMOS device, a third PMOS device, a fourth PMOS device, a first NMOS device, a second NMOS device, a third NMOS device, and a fourth NMOS device. Gate terminals of the first and second PMOS devices are connected to the second chopping switch circuit, gate terminals of the third and fourth PMOS devices are connected to a first voltage rail, gate terminals of the first and second NMOS devices are connected to a second voltage rail, and gate terminals of the third and fourth NMOS devices are connected to a third voltage rail.

In an embodiment, the third voltage rail is connected to a drain terminal of the first NMOS device.

In an embodiment, a mobile device includes the amplifier.

In an embodiment, a constant-current LED driver circuit includes the amplifier, resistors, and switches.

In an embodiment, a constant-current LED driver integrated circuit (IC) device includes the constant-current LED driver circuit, a current mirror, and a reference current generator.

In an embodiment, an LED system includes the constant-current LED driver IC device and LED diode strings.

In an embodiment, an amplifier for a constant-current LED driver circuit includes a folded cascode input stage and a rail-to-rail output stage connected to the folded cascode input stage. The folded cascode input stage includes a differential input stage connected to a first current source, a current sink connected to second and third current sources, and first and second chopping switch circuits configured to perform frequency chopping to reduce an input offset of the amplifier. The rail-to-rail output stage includes a first driver circuit with a first slew rate enhancement circuit and a second driver circuit with a second slew rate enhancement circuit. Gate terminals of semiconductor devices of the first and second driver circuit are connected to voltage rails.

In an embodiment, each of the first and second chopping switch circuits includes switches connected between input terminals and output terminals of the first chopping switch circuit. The switches are controlled by either a clock signal or an inverted version of the clock signal. Each of the first and second slew rate enhancement circuits includes a voltage source, an NMOS device, and a comparator connected to the voltage source and to the NMOS device.

In an embodiment, the first slew rate enhancement circuit is configured to receive input voltages that are identical to voltages applied to gate terminals of transistor devices of the differential input stage.

In an embodiment, a constant-current LED driver integrated circuit (IC) device includes a current mirror having current mirror cells, a reference current generator configured to generate a reference current, and LED driver circuits configured to generate LED driving currents based on output currents generated by the current mirror. Each of the current mirror cells includes a first PMOS device and a second PMOS device configured to generate an output current based on the reference current and a control module configured to alternately and continuously charge the first and second PMOS devices in response to non-overlapping clock signals. Each of LED driver circuits includes an amplifier. The amplifier includes a folded cascode input stage including chopping switch circuits configured to perform frequency chopping to reduce an input offset of the amplifier and a rail-to-rail output stage connected to the folded cascode input stage and including slew rate enhancement circuits.

Other aspects and advantages of embodiments of the present invention will become apparent from the following detailed description, taken in conjunction with the accompanying drawings, depicted by way of example of the principles of the invention.

BRIEF DESCRIPTION OF THE DRAWINGS

Throughout the description, similar reference numbers may be used to identify similar elements.

DETAILED DESCRIPTION

It will be readily understood that the components of the embodiments as generally described herein and illustrated in the appended figures could be arranged and designed in a wide variety of different configurations. Thus, the following detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

Figure 1:
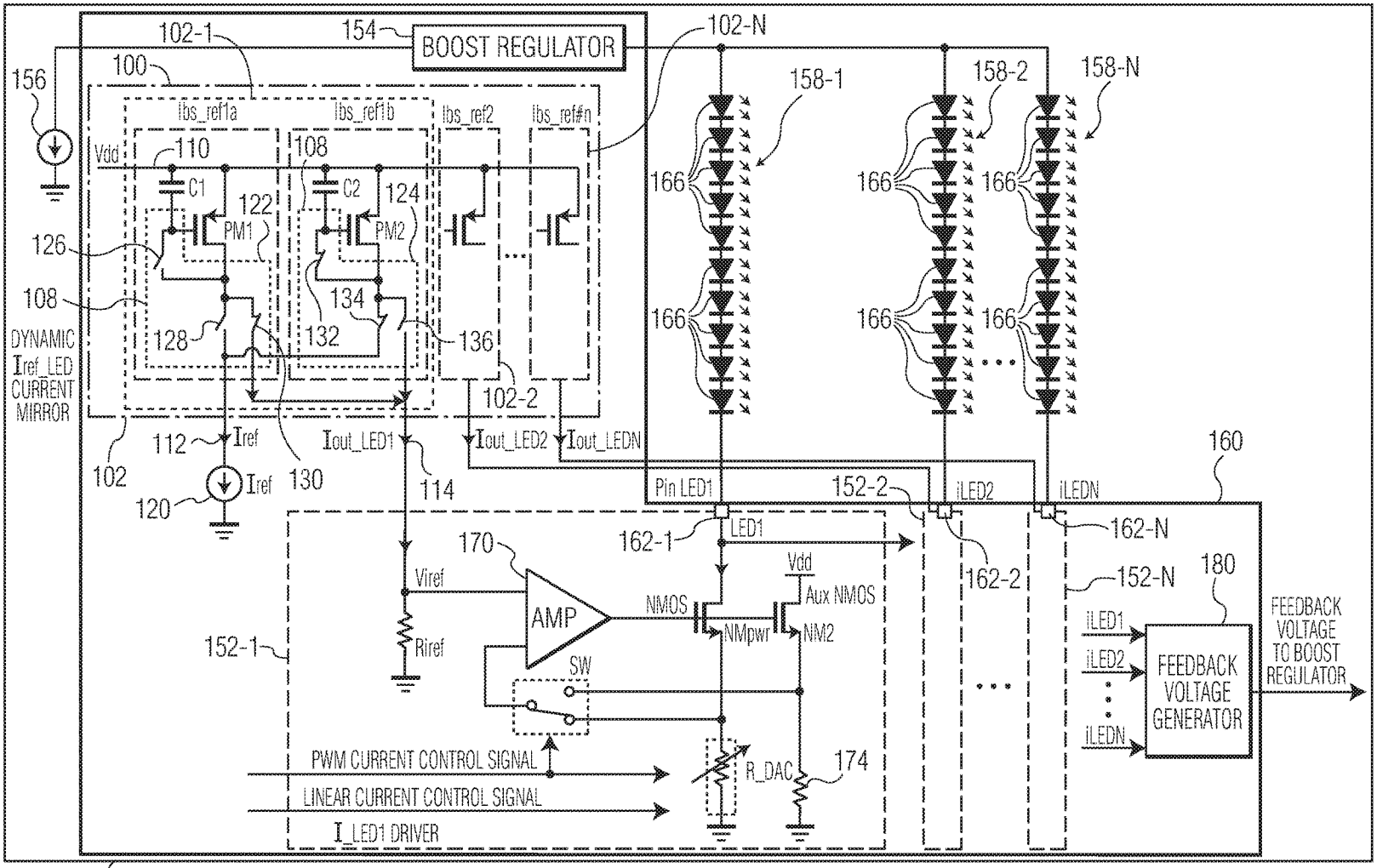
FIG. 1 is a schematic block diagram of an LED system in accordance with an embodiment of the invention.

FIG. 1 is a schematic block diagram of an LED system 140 in accordance with an embodiment of the invention. In the embodiment depicted in FIG. 1, the LED system includes a reference current generator 120, a current mirror 100 with multiple current mirror cells 102-1, . . . , 102-N (N being an integer that is larger than 1), multiple LED driver circuits 152-1, . . . , 152-N, a boost regulator 154, a voltage source 156, and multiple LED diode strings 158-1, . . . , 158-N. In some embodiments, one or more components of the LED system are integrated into an IC device. For example, the current mirror, the reference current generator, and the LED driver circuits may be integrated into an LED driver IC device while the LED strings are separate from the LED driver IC device. Compared to a conventional LED system that utilizes device matching techniques, the LED system can offer high LED current accuracy and low channel-to-channel mismatch.

In the embodiment depicted in FIG. 1, a current mirror cell 102-1 includes capacitors, "C1," "C2," a first PMOS device, "PM1," a second PMOS device, "PM2," and a control module 108 for controlling the first and second PMOS devices. The first and second PMOS devices, PM1, PM2, are connected to a voltage rail 110 with a voltage, "$V_{dd}$," and connected to a reference current signal path 112 and connected to a current output signal path 114. The control module 108 includes a first control circuit 122 and a second control circuit 124. The first control circuit and the first PMOS device, PM1, form a first current mirror segment, "lbs_ref1*a*." The first control circuit includes a first set of switches, 126, 128, 130, which are connected to the first PMOS device, PM1, connected to the reference current signal path 112, and connected to the current output signal path 114, respectively. The second control circuit 124 and the second PMOS device, PM2, form a second current mirror segment, "lbs_ref1*b*." The second control circuit includes a second set of switches, 132, 134, 136, which are connected between the second PM device, PM2, connected to the reference current signal path, and connected to the current output signal path, respectively. In the LED system 140 depicted in FIG. 1, the reference current generator 120 generates a reference current, "$I_{ref}$," for one or more current mirror cells 102 of the current mirror 100. The current mirror and the LED driver circuits 152-1, . . . , 152-N operate to generate constant drive currents to drive the LED strings 158-1, . . . , 158-N. In the embodiment depicted in FIG. 1, the current mirror includes multiple current mirror cells 102-1, . . . , 102-N that convert the reference current, $I_{ref}$, to multiple output currents, "$I_{out_LED1}$," "$I_{out_LED2}$," . . . , "$I_{out_LEDN}$," for the LED driver circuits 152-1, . . . , 152-N, respectively.

In the LED system 140 depicted in FIG. 1, the voltage source 156 is configured to generate a voltage, "Vdc." The boost regulator 154 up-converts the voltage, Vdc, into multiple voltages for the LED diode strings 158-1, . . . , 158-N. Each of the LED diode strings 158-1, . . . , 158-N includes a number of LEDs 166 that are connected in series. Although each of the LED diode strings is shown in FIG. 1 as including multiple LEDs, in other embodiments, at least one LED diode string of the LED system includes a single diode. In addition, although the LED diode strings are shown in FIG. 1 as including an identical number of LEDs, in other embodiments, two or more LED diode strings of the LED system have a unique (different) number of LEDs. Further, although the LED diode strings are shown in FIG. 1 as including identical LEDs, in other embodiments, one or more LED diode strings of the LED system includes LEDs of different types or sizes.

In the LED system 140 depicted in FIG. 1, the LED driver circuits, 152-1, . . . , 152-N, of the LED system 140 are used to generate output currents, "iLED1," "iLED2," . . . "iLEDN," to drive the LED strings 158-1, . . . , 158-N, respectively, based on the output currents, $I_{out_LED1}$, $I_{out_LED2}$, . . . , $I_{out_LEDN}$ from the current mirror 100. In some embodiments, the LED driver circuits include pins/terminals, 162-1, . . . , 162-N, for outputting driving current for the LED strings. In some embodiments, the pins/terminals, 162-1, . . . , 162-N are pins on an IC chip that enable external electrical connections.

In the embodiment depicted in FIG. 1, the LED driver circuit 152-1 includes a resistor, "R_DAC," a resistor, "$R_{iref}$," an amplifier 170 with frequency chopping, an NMOS device, "NMpwr," an auxiliary NMOS device, "NM2," a feedback control switch, "SW," and a resistor 174. The LED driver circuit 152-1 uses a closed loop to set the voltage on the resistor, R_DAC, to be equal to the reference voltage, $V_{iref}$, that is generated by the output current, $I_{out_LED1}$, passing through the resistor, $R_{iref}$. The closed loop is formed by the amplifier, the NMOS device, NMpwr, the auxiliary NMOS device, NM2, and the feedback control switch, SW. As shown in FIG. 1, the resistor, R_DAC, is controlled by a linear current control signal and a Pulse-width modulation (PWM) current control signal, while the feedback control switch, SW, is controlled by the PWM current control signal. The NMOS device, NMpwr, generates an output LED current, I_LED1, which is proportional to the current, $I_{out_LED1}$, received at the resistor, $R_{iref}$. The input offset of the amplifier can lead to both current accuracy of the output current, I_LED1, and channel-to-channel mismatch of LED driver output currents. The amplifier can perform frequency chopping to reduce or even remove the input offset of the amplifier. The chopping frequency of the frequency chopping can be the same as the switching frequency of the boost regulator 154 such that the noise generated by the frequency chopping is synchronized with the switching noise of the boost regulator, which can be filtered out together if necessary. In some embodiments, the resistors, Riref, and R_DAC, are tied together to ground such that ground voltages among the LED driver circuits, 152-1, . . . , 152-N, of the LED system 140 can be even.

In some embodiments, the LED system includes an optional feedback voltage generator 180 that is configured to generate a feedback voltage for the boost regulator 154 based on the output currents, iLED1, iLED2, . . . , iLEDN, from the LED driver circuits. Although not shown in FIG. 1, current paths for the output currents, iLED1, iLED2, . . . , iLEDN, are included between the feedback voltage generator and the LED driver circuits and a voltage signal path for the feedback voltage is included between the feedback voltage generator and boost regulator.

In some embodiments, the current mirror 100, the reference current generator 120, the LED driver circuits, 152-1, . . . , 152-N, the feedback voltage generator 180, and the boost regulator 154 form an LED driver IC device 160. Although the LED driver IC device is shown in FIG. 1 as including certain components, in other embodiments, the LED driver IC device may include more or fewer circuit components to realize more or fewer functionalities.

Figure 2:
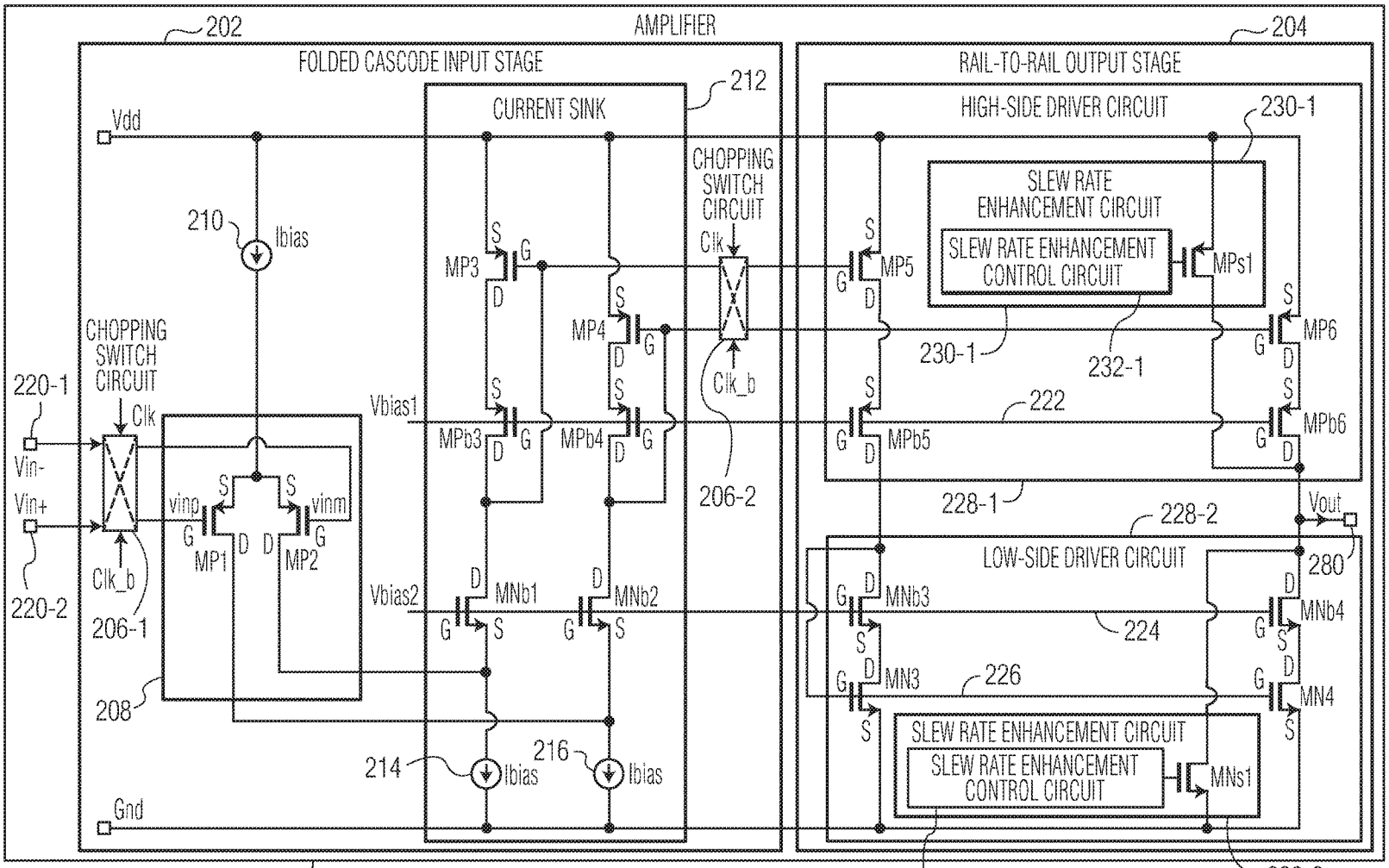
FIG. 2 depicts an embodiment of an amplifier of a constant-current LED driver circuit of the LED system depicted in FIG. 1.

FIG. 2 depicts an embodiment of the amplifier 170 of the constant-current LED driver circuit 152-1 depicted in FIG. 1. In the embodiment depicted in FIG. 2, an amplifier 270 includes a folded cascode input stage 202 with chopping switch circuits 206-1, 206-2 and a rail-to-rail output stage 204 with slew rate enhancement circuits 230-1, 230-2. The amplifier depicted in FIG. 2 is one possible embodiment of the amplifier 170 depicted in FIG. 1. However, the amplifier 170 depicted in FIG. 1 is not limited to the embodiment shown in FIG. 2.

A conventional amplifier typically does not satisfy the current accuracy requirement and the fast Pulse Width Modulation (PWM) dimming requirement of a constant-current driver circuit 152-1. The accuracy requirement is usually defined as 1) the current value's absolute accuracy of each LED string and 2) the channel-to-channel current mismatch among the multiple LED strings. The fast PWM dimming function requirement is generally defined as quickly turning on and off a constant LED current at a given duty ratio of a high (and invisible) frequency so that the average current in an LED driver is proportional to the PWM duty ratio. For example, a conventional amplifier can only achieve 4%-6% accuracy depending on the accuracy of the input voltage offset. In addition, a conventional amplifier typically needs a high biasing current in order to perform a fast Pulse Width Modulation (PWM) turn on/off function. However, mobile applications generally cannot tolerate high quiescent current. Compared to a conventional amplifier, the amplifier 270 depicted in FIG. 2 with the chopping switch circuits 206-1, 206-2 and the slew rate enhancement circuits 230-1, 230-2 can provide high LED current accuracy and fast response for PWM dimming performance while consuming low quiescent current, which is critical for mobile applications. For example, chopping switch circuits are used to reduce the input offset to improve LED current accuracy. In addition, slew rate enhancement circuits are used to reduce the total quiescent current while still achieving the same or even faster PWM turn on/off speed. Consequently, compared to a conventional amplifier, the amplifier depicted in FIG. 2 can be used in a mobile device that requires high LED current accuracy and fast dimming of the current. For example, the amplifier depicted in FIG. 2 can satisfy a 2% channel to channel mismatch threshold and improve the driving speed by, for example, between 3 times and 5 times.

In the amplifier 270 depicted in FIG. 2, the input stage 202 is a folded cascode structure that allows the input voltage to be a low voltage, e.g., in the range of 150 mV. In the embodiment depicted in FIG. 2, the folded cascode input stage includes the first chopping switch circuit 206-1, a differential input stage 208, a first current source 210 connected to the differential input stage, a current sink 212, second and third current sources 214, 216 connected to the current sink, and the second chopping switch circuit 206-2.

The first chopping switch circuit 206-1 is located at input terminals 220-1, 220-2 of the input stage 202 while the second chopping switch circuit 206-2 is located at the output of the input stage and is connected to the rail-to-rail output stage 204. In some embodiments, the input terminals 220-1, 220-2 are pins on an IC chip that enable external electrical connections. The first and second chopping switch circuits can effectively move the DC offset voltage of the amplifier 270 to a targeted high-frequency range such that the DC input offset voltage can be set close to zero. For example, the chopped DC offset voltage can be moved to the chopping clock frequency of around 1 MHz. The noise at 1 MHz is visually un-observable and is synchronized with system noise that can be filtered easily.

Figure 3:
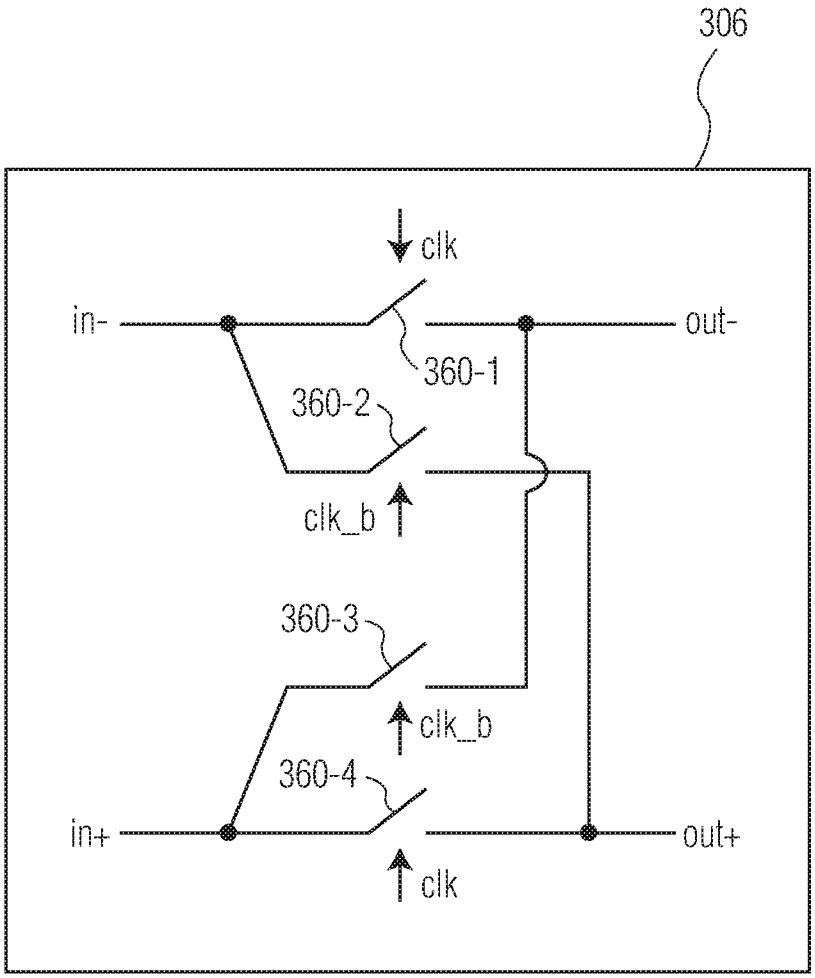
FIG. 3 depicts an embodiment of a chopping switch circuit of the amplifier depicted in FIG. 2.

FIG. 3 depicts an embodiment of a chopping switch circuit 206-1 or 206-2 of the amplifier 270 depicted in FIG. 2. The chopping switch circuit 306 depicted in FIG. 3 is one possible embodiment of the chopping switch circuits depicted in FIG. 2. However, the chopping switch circuits depicted in FIG. 2 are not limited to the embodiment shown in FIG. 3. In the embodiment depicted in FIG. 3, the chopping switch circuit includes a first switch 360-1, a second switch 360-3, a third switch 360-3, and a fourth switch 360-4 that are connected between input terminals, "in−," "in+," and output terminals, "out−," "out+," of the chopping switch circuit. Specifically, the first switch 360-1 is connected between the input terminal, in−, and the output terminal, out−, and is controlled by a clock signal, "clk." The second switch 360-2 is connected between the input terminal, in−, and the output terminal, out+, and is controlled by a clock signal, "clk_b," which is an inverted version of the clock signal, clk. The third switch 360-3 is connected between the input terminal, in+, and the output terminal, out−, and is controlled by the clock signal, clk_b. The fourth switch 360-4 is connected between the input terminal, in+, and the output terminal, out+, and is controlled by the clock signal, clk.

Figure 4A:
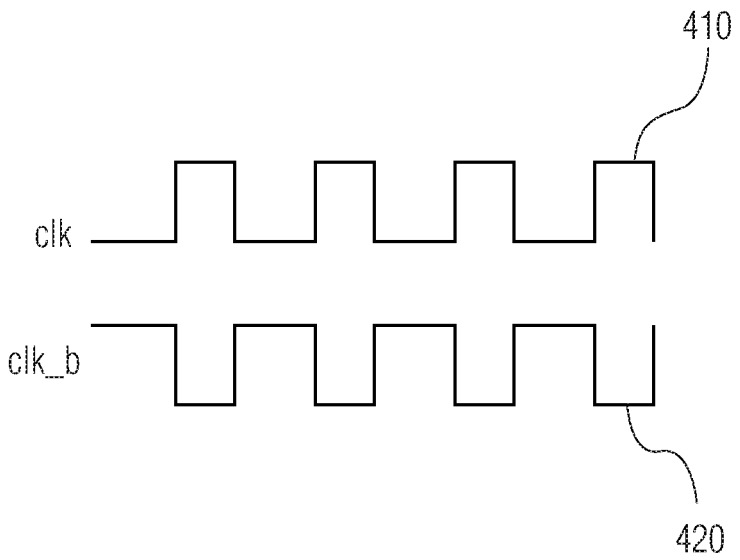
FIG. 4A shows example waveforms of clock signals applied to the chopping switch circuit depicted in FIG. 3.
Figure 4B:
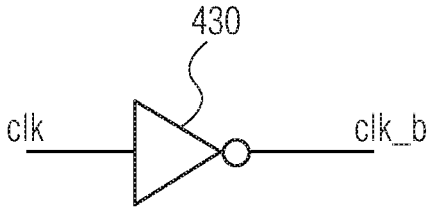
FIG. 4B depicts an inverter circuit for generating a clock signal from another clock signal.

FIG. 4A shows example waveforms 410, 420 of the clock signals, clk, clk_b, that are applied to the chopping switch circuit depicted in FIG. 3. As shown in FIG. 4A, the clock signal, clk_b, is an inverted version of the clock signal, clk. Although the clock signals, clk, clk_b, are shown in FIG. 4A as square waves, in other embodiments, other waveforms (e.g., sine, triangle, and sawtooth waveforms) can also be used. FIG. 4B depicts an inverter circuit 430 for generating the clock signal, clk_b, from the clock signal, clk. As depicted in FIG. 4B, the inverter circuit inverts the clock signal, clk, to generate the clock signal, clk_b.

In an example of the operation of the chopping switch circuit 306, when the clock signal, clk, is at logical high, "1," the clock signal, clk_b is at logical low, "0." The logical high of the clock signal, clk, causes the switches 360-1, 360-4 to close (i.e., in a conductive state), while the logical low of the clock signal, clk_b, causes the switches 360-2, 360-3 to open (i.e., in a non-conductive state), and the voltages at the output terminals, out−, out+, of the chopping switch circuit are identical to the voltages at the input terminals, in−, in+, of the chopping switch circuit, respectively. When the clock signal, clk, is at logical high, "0," the clock signal, clk_b is at logical high, "1." The logical low of the clock signal, clk, causes the switches 360-1, 360-4 to open, while the logical high of the clock signal, clk_b, causes the switches 360-2, 360-3 to close, and the voltages at the output terminals, out−, out+, of the chopping switch circuit are identical to the voltages at the input terminals, in+, in−, of the chopping switch circuit, respectively.

Turning back to FIG. 2, the differential input stage 208 is connected to the first chopping switch circuit 206-1 and to the current sink 212. In the embodiment depicted in FIG. 2, the differential input stage includes two PMOS transistors, "MP1," "MP2." Gate terminals, "G," of the two PMOS transistors, MP1, MP2 are connected to the first chopping switch circuit, source terminals, "S," of the two PMOS transistors, MP1, MP2 are connected to the first current source 210, and drain terminals, "D," of the two PMOS transistors, MP1, MP2 are connected to the current sink.

In the amplifier 270 depicted in FIG. 2, the current sink 212 is connected to the differential input stage 208, to the second chopping switch circuit 206-2, and to the rail-to-rail output stage 204. The current sink includes PMOS transistor, "MP3," a second PMOS transistor, "MP4," a third PMOS transistor, "MPb3," a fourth PMOS transistor, "MPb4," a first NMOS transistor, "MNb1," and a second NMOS transistor, "MNb2." Gate terminals, G, of the PMOS transistors, MP3, MP4, are connected to the second chopping switch circuit 206-2. Source terminals, S, of the PMOS transistors, MP3, MP4, are connected to a voltage, "Vdd." Drain terminals, D, of the PMOS transistors, MP3, MP4, are connected to source terminals, S, of the PMOS transistors, MPb3, MPb4. Gate terminals, G, of the PMOS transistors, MPb3, MPb4, are connected to a voltage rail/line 222 to which a voltage, "Vbias1," is applied. Drain terminals, D, of the PMOS transistors, MP3, MP4, are connected to drain terminals, D, of the NMOS transistors, MNb1, MNb2. Gate terminals, G, of the NMOS transistors, MNb1, MNb2, are connected to a voltage rail 224 to which a voltage, "Vbias2," is applied. Source terminals, S, of the NMOS transistors, MNb1, MNb2, are connected to current sources 214, 216, which are connected to ground (GND).

In the embodiment depicted in FIG. 2, the output stage 204 is a rail-to-rail structure configured to drive the output NMOS transistor, NMpwr, (shown in FIG. 1) over full voltage range. In the embodiment depicted in FIG. 2, the output stage includes a high-side driver circuit 228-1 with the high-side slew rate enhancement circuit 230-1 and a low-side driver circuit 228-2 with the low-side slew rate enhancement circuit 230-2. The high-side slew rate enhancement circuit 230-1 includes a high-side slew rate control circuit 232-1 and a PMOS transistor, "MPs1." The low-side slew rate enhancement circuit 230-2 includes a high-side slew rate control circuit 232-2 and an NMOS transistor, "MNs1." The high-side and low-side slew rate enhancement circuits can be used to improve the driving speed of the amplifier 270. Because the amplifier is formed in a feedback loop, the 'Vin−' voltage can be used as the output voltage of the LED driver circuit 152-1.

In the rail-to-rail output stage 204, the high-side driver circuit 228-1 includes a first PMOS transistor, "MP5," a second PMOS transistor, "MP6," a third PMOS transistor, "MPb5," a fourth PMOS transistor, "MPb6," a first NMOS transistor, "MNb3," a second NMOS transistor, "MNb4," a third NMOS transistor, "MN3,' and a fourth NMOS transistor, "MN4." Gate terminals, G, of the PMOS transistors, MP5, MP6, are connected to the second chopping switch circuit 206-2. Source terminals, S, of the PMOS transistors, MP5, MP6, are connected to the voltage, Vdd. Drain terminals, D, of the PMOS transistors, MP5, MP6, are connected to source terminals, S, of the PMOS transistors, MPb5, MPb6. Gate terminals, G, of the PMOS transistors, MPb5, MPb6, are connected to the voltage rail 222. Drain terminals, D, of the PMOS transistors, MPb5, MPb6, are connected to drain terminals, D, of the NMOS transistors, MNb3, MNb4 and to an output terminal 280 from which a voltage, "Vout," is output. Gate terminals, G, of the NMOS transistors, MNb3, MNb4, are connected to the voltage rail 224. Drain terminals, D, of the NMOS transistors, MNb3, MNb4, are connected to drain terminals, D, of the PMOS transistors, MPb5, MPb6, and to the output terminal 280. Source terminals, S, of the NMOS transistors, MNb3, MNb4, are connected to drain terminals, D, of the NMOS devices, MN3, MN4. Gate terminals, G, of the NMOS devices, MN3, MN4, are connected to a voltage rail 226, which is connected to the drain terminal, D, of the NMOS device, MNb3. Source terminals, S, of the NMOS devices, MN3, MN4, are connected to the ground (GND).

An example of the operation of the amplifier 270 depicted in FIG. 2 is described as follows. In a steady state of the amplifier, the Vin+ and Vin− voltages are equal. When there is a transient output current step event such as a PWM turning on or turning off, the Vin+ and Vin− voltages differ transiently. The transient input voltage difference can be used to enable the slew rate enhancement circuits 230-1, 230-2. An example operation of slew rate enhancement circuits is described below with respect to FIG. 5.

Figure 5:
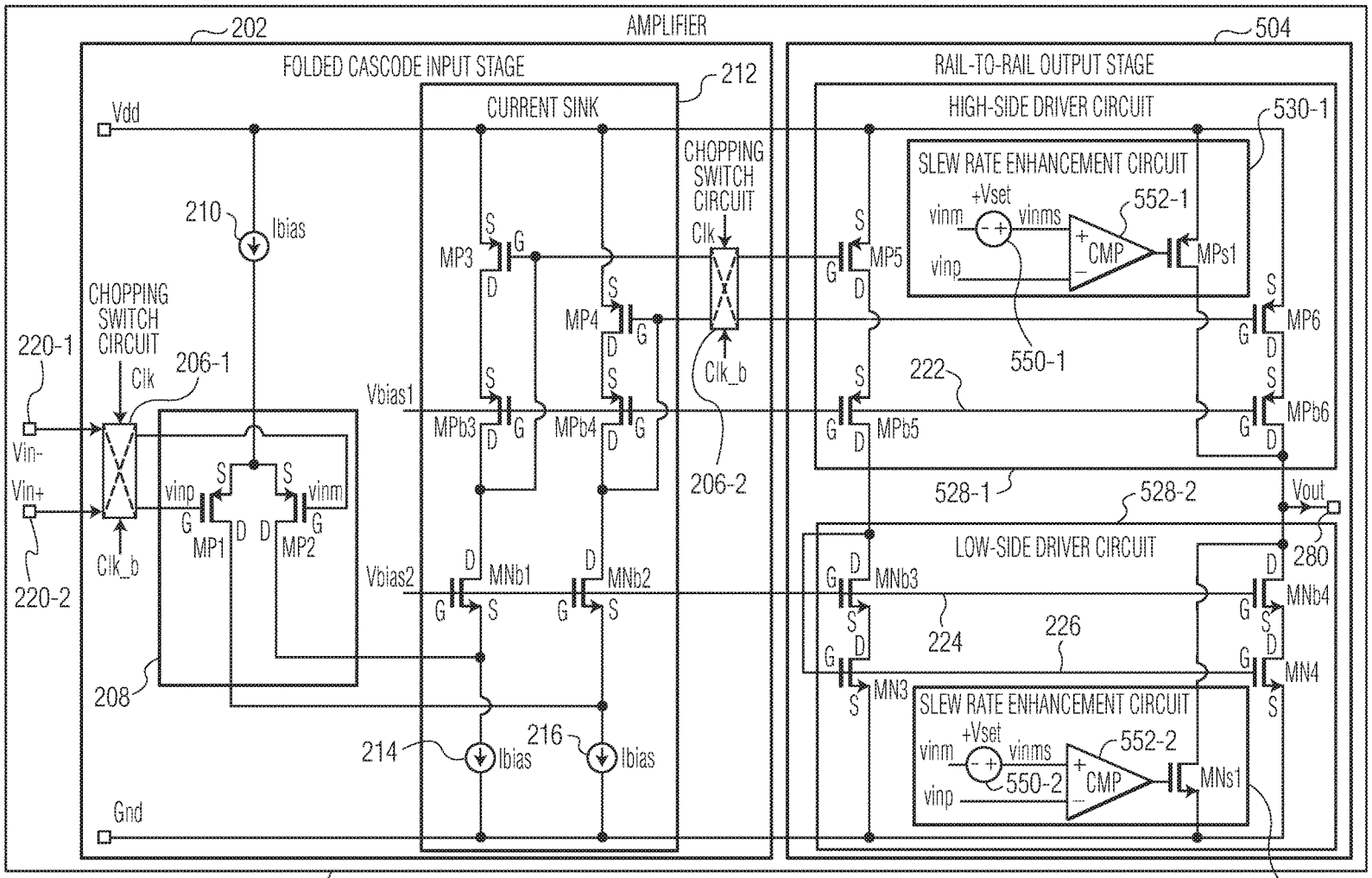
FIG. 5 depicts an embodiment of the amplifier depicted in FIG. 2 that includes two slew rate enhancement circuits.

FIG. 5 depicts an embodiment of the amplifier 270 depicted in FIG. 2 that includes a high-side slew rate enhancement circuit 530-1 and a low-side slew rate enhancement circuit 530-2. Each of the slew rate enhancement circuits includes a voltage source 550-1 or 550-2, a comparator 552-1 or 552-2, and a PMOS transistor or an NMOS transistor. In the embodiment depicted in FIG. 5, the amplifier 570 includes the folded cascode input stage 202 and a rail-to-rail output stage 504 with the high-side slew rate enhancement circuit 530-1 and the low-side slew rate enhancement circuit 530-2. The amplifier 570 depicted in FIG. 5 is one possible embodiment of the amplifier 270 depicted in FIG. 2. However, the amplifier 270 depicted in FIG. 2 is not limited to the embodiment shown in FIG. 5.

In the amplifier 570 depicted in FIG. 5, the rail-to-rail output stage 504 includes a high-side driver circuit 528-1 having the high-side slew rate enhancement circuit 530-1 and a low-side driver circuit 528-2 having the low-side slew rate enhancement circuit 530-2. The high-side slew rate enhancement circuit 530-1 includes a voltage source 550-1, a comparator 552-1, and a PMOS transistor, "MPs1." The low-side slew rate enhancement circuit 530-2 includes a voltage source 550-2, a comparator 552-2, and an NMOS transistor, "MNs1." Each slew rate enhancement circuit 530-1 or 530-2 sets up a preset voltage, "Vset," between input voltages, "vinp" and "vinm," of the corresponding comparator. The input voltages, "vinp" and "vinm," of the comparator are identical to the voltage applied to gate terminals, G, of the PMOS transistors, MP1, MP2, of the differential input stage of the amplifier. The slew rate enhancement circuits can be effectively incorporated into the amplifier 570 based on the existing output currents from the outputs of the folded cascode stage 202. The 'Vset' voltage can be chosen and set up by using the combination of differential output currents.

An example of the operations of the high-side slew rate enhancement circuit 530-1 and the low-side slew rate enhancement circuit 530-2 depicted in FIG. 5 is described as follows. During transient events, when the input voltage difference is undershot more than the voltage, Vset, of the voltage source, which means that the difference between the voltage, vinp, and the voltage, vinm, (i.e., the voltage, vinp, minus the voltage, vinm) is more than the voltage, Vset, the NMOS transistor, MNs1, of the low-side slew rate enhancement circuit is turned on to quickly discharge the voltage, "Vout," at the output terminal/node 280. The NMOS transistor, MNs1, will be turned off when 'Vin+' minus 'Vin−' is less than the 'Vset'. Alternatively, during a transient event, when the input voltage difference is overshot more than the voltage, Vset, of the voltage source, which means that the difference between the voltage, vinp, and the voltage, vinm, (i.e., the voltage, vinm, minus the voltage, vinp) is more than the voltage, Vset, the PMOS transistor, MPs1, of the high-side slew rate enhancement circuit is turned on to quickly charge the voltage, "Vout," at the output node 280. Compared to an amplifier without a slew rate enhancement circuit, the amplifier with high-side and low-side slew rate enhancement circuits depicted in FIG. 5 can improve the driving speed by, for example, between 3 times and 5 times.

Although specific embodiments of the invention that have been described or depicted include several components described or depicted herein, other embodiments of the invention may include fewer or more components to implement less or more features.

In addition, although specific embodiments of the invention have been described and depicted, the invention is not to be limited to the specific forms or arrangements of parts so described and depicted. The scope of the invention is to be defined by the claims appended hereto and their equivalents.

What is claimed is:

1. An amplifier for a constant-current light-emitting diode (LED) driver circuit, the amplifier comprising:

a folded cascode input stage comprising a plurality of chopping switch circuits configured to perform frequency chopping to reduce an input offset of the amplifier; and a rail-to-rail output stage coupled to the folded cascode input stage, the rail-to-rail output stage comprising a plurality of slew rate enhancement circuits;

wherein the plurality of chopping switch circuits comprise a first chopping switch circuit and a second chopping switch circuit;

wherein the first chopping switch circuit is coupled to input terminals of the amplifier;

wherein the second chopping switch circuit is coupled to the rail-to-rail output stage;

wherein the folded cascode input stage further comprises a differential input stage coupled to a first current source and a current sink coupled to second and third current sources;

wherein the differential input stage is coupled to the first chopping switch circuit and to the current sink; and wherein the current sink is coupled to the second chopping switch circuit and to the rail-to-rail output stage.

2. The amplifier of claim 1, wherein the first chopping switch circuit comprises a plurality of switches coupled between input terminals and output terminals of the first chopping switch circuit, and wherein the switches are controlled by either a clock signal or an inverted version of the clock signal.

3. The amplifier of claim 1, wherein the first chopping switch circuit includes a first input terminal, a second input terminal, a first output terminal, and a second output terminal;

wherein the first chopping switch circuit further includes a plurality of switches coupled between the first or second input terminals and the first or second output terminals of the first chopping switch circuit;

wherein the switches are controlled by either a clock signal or an inverted version of the clock signal; and wherein the switches include a first switch coupled between the first input terminal of the first chopping switch circuit and the first output terminal of the first chopping switch circuit and controlled by the clock signal;

a second switch coupled between the first input terminal and the second output terminal of the first chopping switch circuit and controlled by the inverted version of the clock signal;

a third switch is coupled between the second input terminal of the first chopping switch circuit and the first output terminal and controlled by the inverted version of the clock signal; and a fourth switch coupled between the second input terminal and the second output terminal and controlled by the clock signal.

4. The amplifier of claim 1, wherein the differential input stage comprises first and second transistor devices, wherein the first and second transistors each have a gate terminal;

wherein the gate terminals of the first and second transistor devices are coupled to the first chopping switch circuit, wherein the first and second transistors each have a drain terminal and a source terminal; and wherein the drain terminals or the source terminals of the first and second transistor devices are coupled to the first current source.

5. The amplifier of claim 1, wherein the current sink comprises a first PMOS device, a second PMOS device, a third PMOS device, a fourth PMOS device, a first NMOS device, and a second NMOS device, where gate terminals of the first and second PMOS devices are coupled to the second chopping switch circuit, wherein gate terminals of the third and fourth PMOS devices are coupled to a first voltage rail, and wherein gate terminals of the first and second NMOS devices are coupled to a second voltage rail.

6. The amplifier of claim 1, wherein the rail-to-rail output stage comprises:

a first driver circuit with a first slew rate enhancement circuit; and a second driver circuit with a second slew rate enhancement circuit.

7. The amplifier of claim 6, wherein the first slew rate enhancement circuit comprises a voltage source, an NMOS device, and a comparator coupled to the voltage source and to the NMOS device.

8. The amplifier of claim 7, wherein the differential input stage includes a plurality of transistor devices;

wherein each of the plurality of transistor devices includes a gate terminal; and wherein the first slew rate enhancement circuit is configured to receive a plurality of input voltages that are identical to voltages applied to the gate terminals of the plurality of transistor devices of the differential input stage.

9. The amplifier of claim 6, wherein the rail-to-rail output stage comprises a first PMOS device, a second PMOS device, a third PMOS device, a fourth PMOS device, a first NMOS device, a second NMOS device, a third NMOS device, and a fourth NMOS device, where gate terminals of the first and second PMOS devices are coupled to the second chopping switch circuit, wherein gate terminals of the third and fourth PMOS devices are coupled to a first voltage rail, wherein gate terminals of the first and second NMOS devices are coupled to a second voltage rail, and wherein gate terminals of the third and fourth NMOS devices are coupled to a third voltage rail.

10. The amplifier of claim 9, wherein the third voltage rail is coupled to a drain terminal of the first NMOS device.

11. A mobile device comprising the amplifier of claim 1.

12. A constant-current LED driver circuit comprising the amplifier of claim 1, a plurality of resistors, and a plurality of switches.

13. A constant-current LED driver integrated circuit (IC) device comprising the constant-current LED driver circuit of claim 12, a current mirror, and a reference current generator.

14. An LED system comprising the constant-current LED driver IC device of claim 13 and a plurality of LED diode strings.

15. An amplifier for a constant-current light-emitting diode (LED) driver circuit, the amplifier comprising:

a folded cascode input stage comprising:

a differential input stage coupled to a first current source;

a current sink coupled to second and third current sources; and first and second chopping switch circuits configured to perform frequency chopping to reduce an input offset of the amplifier; and a rail-to-rail output stage coupled to the folded cascode input stage, the rail-to-rail output stage comprising:

a first driver circuit with a first slew rate enhancement circuit; and a second driver circuit with a second slew rate enhancement circuit, wherein gate terminals of semiconductor devices of the first and second driver circuit are coupled to a plurality of voltage rails;

wherein the first chopping switch circuit comprises a plurality of switches coupled between input terminals and output terminals of the first chopping switch circuit;

wherein the switches are controlled by either a clock signal or an inverted version of the clock signal; and wherein the first slew rate enhancement circuit comprises a voltage source, an NMOS device, and a comparator coupled to the voltage source and to the NMOS device.

16. The amplifier of claim 15, wherein the differential input stage includes a plurality of transistor devices;

wherein each of the plurality of transistor devices includes a gate terminal; and wherein the first slew rate enhancement circuit is configured to receive a plurality of input voltages that are identical to voltages applied to the gate terminals of the plurality of transistor devices of the differential input stage.

* * * * *